United States Patent [19]

Moser et al.

[11] Patent Number: 4,585,328

[45] Date of Patent: Apr. 29, 1986

[54] DEVELOPING APPARATUS FOR A PHOTOCOPYING MACHINE

[75] Inventors: Kurt Moser, Gerlingen, Fed. Rep. of Germany; Karl Moser, Forch, Switzerland

[73] Assignee: Develop Dr. Eisbein GmbH & Co., Fed. Rep. of Germany

[21] Appl. No.: 509,136

[22] Filed: Jun. 29, 1983

[30] Foreign Application Priority Data

Jul. 3, 1982 [DE] Fed. Rep. of Germany ..... 3225006

[51] Int. Cl.[4] ..... G03G 15/08

[52] U.S. Cl. ..... 355/3 DD; 118/261; 118/656

[58] Field of Search ..... 355/3 R, 3 DD; 118/261, 118/413, 656

[56] References Cited

U.S. PATENT DOCUMENTS 3,607,180 9/1971 Merz et al. ..... 118/261 X 4,377,332 3/1983 Tamura ..... 355/3 DD

*Primary Examiner*—Fred L. Braun

*Attorney, Agent, or Firm*—Barnes & Thornburg

[57] ABSTRACT

A photocopying machine developing apparatus is described in which an adjustable doctor blade is disposed adjacent a shell surrounding a magnetic roller. The doctor blade is guided in a U-shaped slideway with respect to the shell and is displaceable in the radial direction by contact with adjusting screws. The doctor blade is pressed against the adjusting screws by tension springs.

10 Claims, 2 Drawing Figures

DEVELOPING APPARATUS FOR A PHOTOCOPYING MACHINE

BACKGROUND AND SUMMARY OF THE INVENTION

The invention relates to developing apparatus for a photocopying machine or the like of the type with a reservoir for toner, the underside of which reservoir is bounded by a shell made out of non-magnetic material, which shell surrounds a magnetic roller and serves to transfer the toner to an adjacent electrostatically charged outer surface of a drum for facilitating photocopying. A doctor blade is provided to adjust the coating thickness of the toner material at the shell, which doctor blade extends in the axial direction of the shell and is radially adjustable with respect to the shell.

An exact adjustment of the radial distance of the doctor blade from the outer surface of the shell is of importance in establishing a uniformly thick layer or coating of toner at the shell over the entire length of the shell. With known developing apparatus, this adjustment of the distance or spacing of the doctor blade to the shell causes difficulties. In these known arrangements, the doctor blade is fastened to the housing of the toner reservoir by means of screws extending through the doctor blade. After loosening of the screws, the doctor blade can be adjusted by means of the play in its bores, whereafter the screws are again tightened. This form of adjustment is especially time consuming and awkward for servicing work. Even more importantly, this arrangement is inexact and unreliable because the danger exists that during the tightening of the screws, the doctor blade will move relative to the shell and the selected adjustment is again lost.

The invention is directed toward solving the problems in building a developing apparatus of the abovementioned kind that facilitates a simple and exact adjustment of the spacing of the doctor blade to the shell. These problems are thereby solved according to the invention in that the doctor blade is arranged in a radially extending slide guide at the circumference of the shell and is held in the radial direction with respect to the shell by means of adjustable adjusting elements arranged in the region of the respective two opposite ends of the shell.

With this arrangement, according to the invention, it is possible in a simpler manner to obtain an exact adjustment of the doctor blade so that a truly uniform thickness toner layer can be obtained. Because the adjustment possibilities are actually very exact, it is also possible to adjust the spacing by smaller amounts than previously was normal.

In an advantageous preferred embodiment of the invention, it is provided that a wall of the reservoir chamber extending radially with respect to the shell and several leaf springs together form a U-shaped slide guide facing the shell. The doctor blade is guided in this slide guide without play. In the region of the reservoir opposite the shell radially extending treaded bores are disposed in a protrusion at the reservoir between the radially extending reservoir wall and the leaf springs. Adjusting screws are arranged in these bores which abut against the upper surface (radially outermost surface) of the doctor blade opposite the shell. In order to facilitate a play-free adjustment of the doctor blade, the upper surface of the doctor blade is resiliently held against the adjusting screws by means of springs.

Further objects, features, and advantages of the present invention will be more obvious from the following description when taken in connection with the accompanying drawings which show, for purposes of illustration only, one embodiment in accordance with the present invention.

DETAILED DESCRIPTION OF THE DRAWINGS

In order not to obscure the present invention, only those features are illustrated and described as are necessary to an understanding of the invention. Those skilled in the art of photocopying machines will readily be able to practice the invention, given the present disclosure and the known state of the art of photocopying machines.

Figure 1:
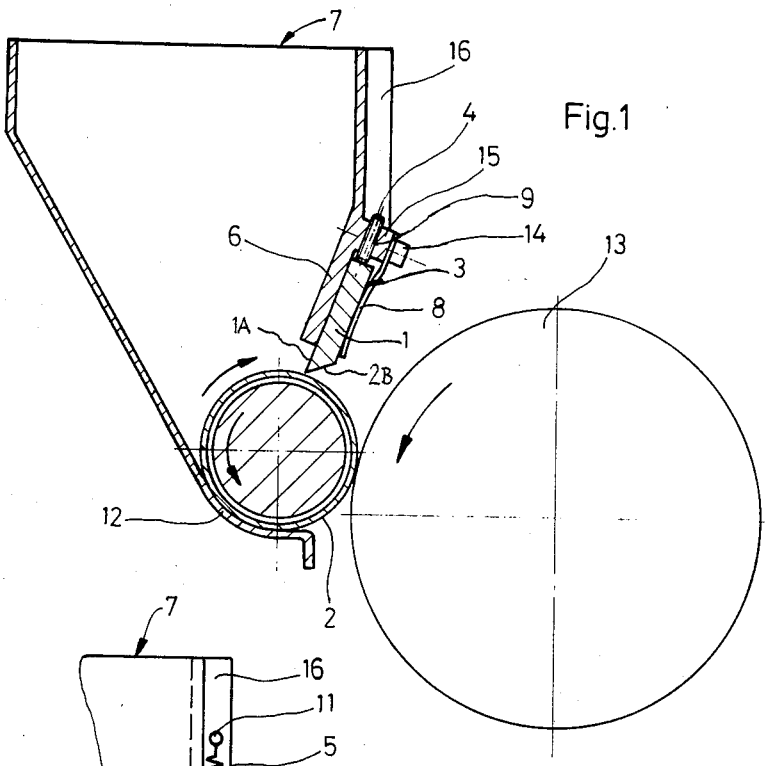
FIG. 1 is a schematic part-sectional view through a portion of a developing apparatus constructed in accordance with a preferred embodiment of the invention.
Figure 2:
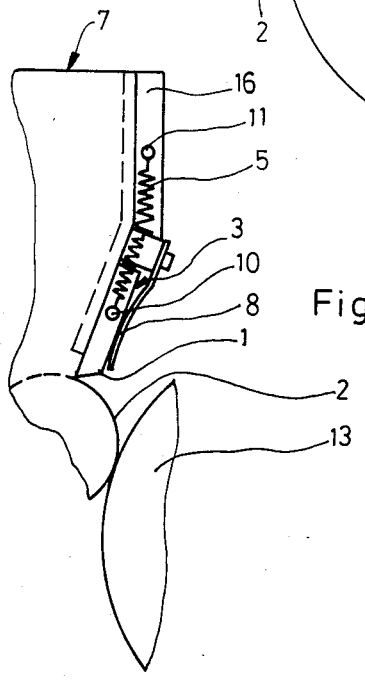
FIG. 2 is a partial side view of the developing apparatus of FIG. 1.

In FIG. 1 there is shown a reservoir 7 for toner which is tapered to narrow at its underside. The underside opf the reservoir is open at the side. A tubular toner transfer shell 2, constructed of nonmagnetizable material, is located at the open lower side of the reservoir 7. A magnetic roller 12 is arranged inside of this shell 2. The roller 12 and the shell 2 are respectively rotatably driven in the direction indicated by the arrows by a drive mechanism which is not illustrated. Adjacent the shell 2 at a small distance or spacing, there is arranged a drum 13, the circumference of which drum 13 is provided with a semi-conductive material to be loaded electrostatically as a charging pattern by meand of a charging station and an exposure apparatus of the copying machine.

The drum 13 and the shell 2 are rotated oppositely with respect to one another so that there results a corresponding similar movement in both of them in oppositely facing regions. The magnetic roller 12, which is formed out of a large number of circumferentially extending magnets of alternating opposite poles, turns in the opposing direction to that of the shell 2.

Toner is transported from the reservoir 7 onto the shell 2 and to the outer surface of the drum 13 as the respective parts are rotated. In order to establish a uniform layer thickness for the toner at the shell 2, the housing 7 is provided with a doctor blade 1, which extends in the axial direction along the shell 2 and is spaced a small distance therefrom with a sharpened edge thereof. The surface of the doctor blade at the side of the reservoir extends radially (side 1A) so that the doctor blade 1 is sharpened only at one side (side 1B).

As can especially be seen in FIG. 1, the doctor blade 1 need not be made out of sheet metal, but rather can be manufactured also in the form of a plate.

The doctor blade 1 is guided in the slide guide or slide way 3 extending in the radial direction with respect to the shell 2. The slide way 3 is formed by radially extending wall 6 of the reservoir 7 and several leaf springs 8 disposed over the length of the doctor blade 1, which springs 8 push the doctor blade 1 against the wall 6. The leaf springs 8 are fastened to protruding rib or ribs 15 of the wall 6 by means of screws 14, which ribs 15 are furthermore provided in the region of both lateral ends of the doctor blade with threaded bores 9, in which bores adjusting screws 4 are screwed which are in the form of set screws. The adjusting set screws 4 and the threaded bores 9 possess fine threads. It is sufficient to have respective adjusting screws 4 in the region of the lateral ends of the doctor blade in order to obtain and maintain a very exact and balanced orientation of the doctor blade with respect to the shell 2.

The doctor blade 1 is pulled against the ends of the adjusting screws 4 with the help of tension springs 5. The lateral ends of the doctor blade 1 are provided with protrusions 10 in which the springs are hooked. The other ends of the springs 5 are hooked at protrusions 11 provided at a rib 16 of the wall of the reservoir 7.

The excellent adjustability of the doctor blade 1 facilitates easy and exact adjustment thereof by a service person. For example, such adjustments may be made when the machine is modified to use another toner material after the machine has already been in operation with a different toner. Because of the fact that the doctor blade adjusting screws 4 are disposed at the lateral ends of the doctor blade 1 and outside of the reservoir 7 they are accessable without any difficulty for a service person so that they can without difficulty exactly adjust the doctor blade spacing with the aid of a guiding ledge or gauge between the shell 2 and the doctor blade 1.

While we have shown and described a single preferred embodiment in accordance with the present invention, it is understood that the same is not limited thereto but is susceptible to numerous changes and modifications as would be known to those skilled in the art of the present disclosure and we, therefore, do not wish to be limited to the details shown and described therein but intend to cover all such changes and modifications as are encompassed by the scope of the appended claims.

We claim:

1. Developing apparatus for a photocopying machine or the like comprising:

a reservoir for toner material, a tubular toner transfer shell disposed at an opening in the reservoir, the outer surface of said shell being configured to transfer toner from the reservoir to a drum upon rotation of the shell, a doctor blade disposed in facing relationship to the circumference of the shell to control the thickness of the layer of toner on the shell, said doctor blade being guided for radial movement with respect to the shell in a slide way, said slide way being a U-shaped slide way facing the shell and formed by a radially extending wall of the reservoir and by leaf spring means, and adjustable adjusting elements disposed at the respective lateral regions of the doctor blade to accommodate adjustment of the position of the doctor blade.

2. Developing apparatus according to claim 1, wherein the reservoir wall is provided with threaded bores at the side of the doctor blade opposite the shell, said bores extending between the radially extending wall and the leaf spring means, and wherein adjusting screws are provided in the threaded bores which abut the side of the doctor blade opposite the shell.

3. Developing apparatus according to claim 2, wherein the adjusting screws and the threaded bores are provided with fine threads to facilitate precise adjustments.

4. Developing apparatus according to claim 2, wherein the side of the doctor blade opposite the shell is held against the adjusting screws by holding spring means.

5. Developing apparatus according to claim 4, wherein the lateral edges of the doctor blade are provided with protrusions, wherein further protrusions are provided at the reservoir, and wherein the holding spring means includes respective tension spring means hooked to said protrusions and further protrusions.

6. Developing apparatus fpr a photocopying machine or the like comprising:

a reservoir for toner material, a tubular toner transfer shell disposed at an opening in the reservoir, the outer surface of said shell being configured to transfer toner from the reservoir to a drum upon rotation of the shell, said shell being disposed at an opening located at the bottom of the reservoir, and said shell being formed of magnetizable material and enclosing a magnetic roller, said drum having an electrostatically chargeable outer surface for accepting the toner from the shell, a doctor blade disposed in facing relationship to the circumference of the shell to control the thickness of the layer of toner on the shell, said doctor blade being guided for radial movement with respect to the shell in a slide way, said slide way being a U-shaped slide way facing the shell and formed by a radially extending way of the reservoir and leaf spring means, and adjustable elements disposed at the respective lateral regions of the doctor blade to accommodate adjustment of the position of the doctor blade.

7. Developing apparatus according to claim 6, wherein the reservoir wall is provided with threaded bores at the side of the doctor blade opposite the shell, said bores extending between the radially extending wall and the leaf spring means, and wherein adjusting screws are provided in the threaded bores which abut the side of the doctor blade opposite the shell.

8. Developing apparatus according to claim 7, wherein the adjusting screws and the threaded bores are provided with fine threads to faciltiate precise adjustments.

9. Developing apparatus according to claim 8, wherein the side of the doctor blade opposite the shell is held against the adjusting screws by holding spring means.

10. Developing apparatus according to claim 9, wherein the lateral edges of the doctor blade are provided with protrusions, wherein further protrusions are provided at the reservoir, and wherein the holding spring means includes respective tension spring means hooked to said protrusions and further protrusions.

* * * * *